United States Patent [19]

Casanova

[11] Patent Number: 4,829,776

[45] Date of Patent: May 16, 1989

[54] REFRIGERATED CABINET WITH AN IMPROVED CONTROL PANEL

[76] Inventor: Giuseppe Casanova, Via Cavassico Inferiore, 149 - Trichiana (Belluno), Italy

[21] Appl. No.: 153,956

[22] Filed: Feb. 9, 1988

[30] Foreign Application Priority Data

Feb. 20, 1987 [IT] Italy ..... 20900/87[U]

[51] Int. Cl.[4] ..... F25B 49/00

[52] U.S. Cl. ..... 62/125; 62/249; 62/130

[58] Field of Search ..... 62/127, 125, 126, 129, 62/130, 246, 249, 252, 253, 248; 165/11.1; 236/94; 312/223, 116

[56] References Cited

U.S. PATENT DOCUMENTS 4,287,939 9/1981 Pohl et al. ..... 165/11.1

FOREIGN PATENT DOCUMENTS 2646125 4/1977 Fed. Rep. of Germany ..... 62/246
2423737 12/1979 France ..... 62/125
8105874 8/1982 Netherlands ..... 312/116

*Primary Examiner*—Harry B. Tanner
*Attorney, Agent, or Firm*—Nataro & Michalos

[57] ABSTRACT

A refrigerated cabinet wherein a dealer side and an opposedly located customer side are recognizable comprises a plurality of uprights arranged to support a display glazed deck, and an electric console associated with a cabinet refrigerating system to control its operational functions. The electric console includes an elongate box-shaped case mounted close against one of the uprights lying on the cabinet dealer side.

6 Claims, 2 Drawing Sheets

REFRIGERATED CABINET WITH AN IMPROVED CONTROL PANEL

FIELD AND BACKGROUND OF THE INVENTION

This invention relates to a refrigerated cabinet, wherein a dealer side and opposedly located customer side are recognizable, which comprises a plurality of uprights arranged to support a display window, and an electric console associated with a refrigerating system for said cabinet to control the operational functions thereof.

Cabinets of this type are widey used at foodstores whenever it is desired that the customer can have a direct view of the goods on display.

With such prior cabinets, the electric console from where one can control operation of the refrigerating system, such as its compressor, evaporators, and related defrosting arrangements, is located below a work shelf, being mounted to one of the cabinet outer walls.

This location of the electric console, while being an optimum one from the standpoint of non-interference with the dealer activity, disallows on the other hand accurate and continued monitoring of the refrigerating system operation.

It should be considered, however, that the bulk and box-like configuration of consoles currently employed with refrigerated cabinets dictate their mounting to a cabinet wall. Accordingly, the only alternative choice affording continuous monitoring by the dealer would be that of mounting the console on the work shelf of the cabinet.

Such a location brings about, however, a number of problems. A console so located is apt to interfere with the dealer's normal activity, is offensive aesthetically, and becomes a recipient of dirt and organic residue.

SUMMARY OF THE INVENTION

It is the object of this invention to provide a refrigerated cabinet whose electric console is designed and installed to be at all times in full view of the dealer while obviating all the problems which affect the cited prior art.

The solutive idea underlying this invention is one of associating the console with one of the cabinet uprights lying on the dealer side, thereby the console box-like case forms in essence an enlargement of the upright itself.

This solutive idea is embodied by a cabinet of the aforesaid type being characterized in that said console includes an elongate box-like case supported close against one of the uprights lying on said dealer side of the cabinet.

The features and advantages of the invention will be more clearly understood from the following detailed description of a preferred, though not exclusive, embodiment thereof, to be taken in conjunction with the accompanying illustrative drawings.

DESCRIPTION OF THE PREFERRED EMBODIMENT

Figure 1:
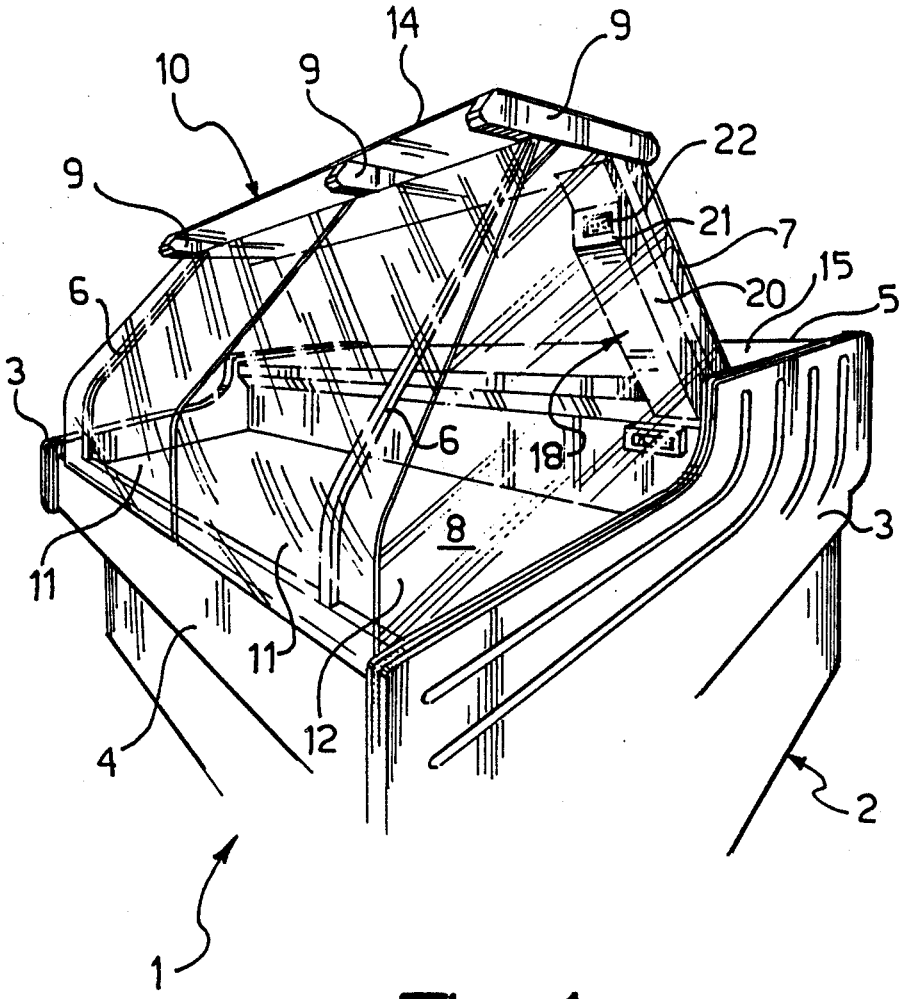
FIG. 1 is a perspective view of a refrigerated cabinet according to the invention, taken from the customer side thereof.
Figure 2:
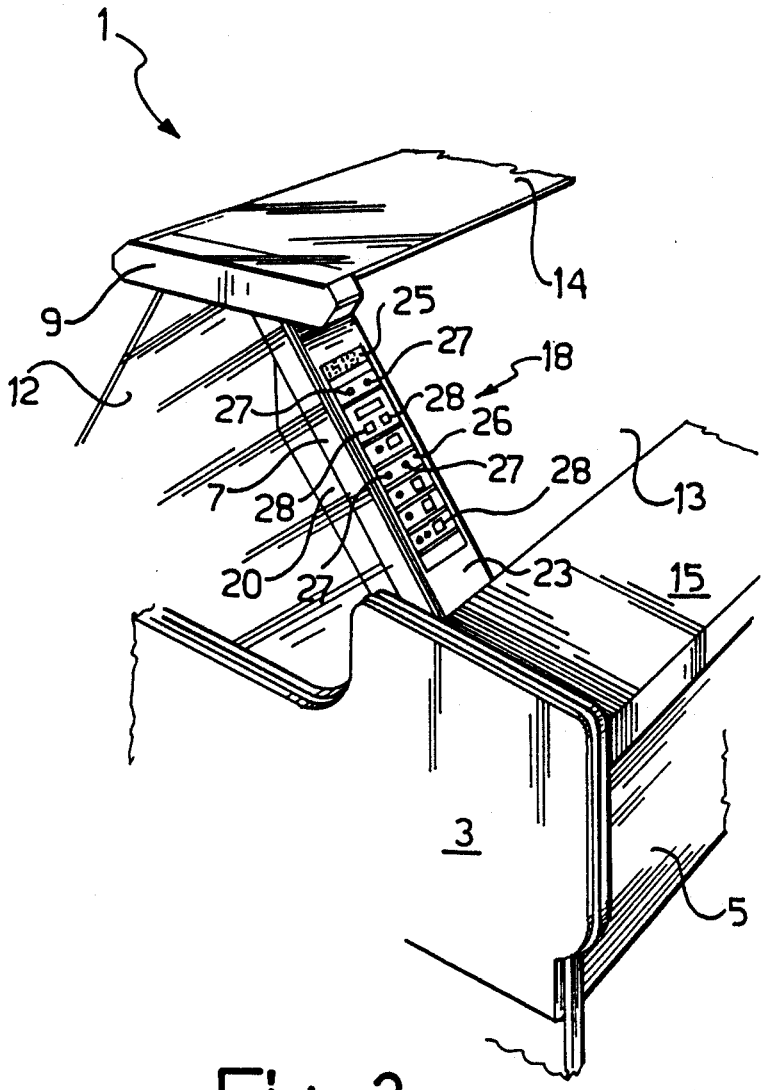
FIG. 2 is a fragmentary perspective view of the cabinet shown in FIG. 1, taken from the dealer side thereof.

In the accompanying drawings, the reference numeral 1 comprehensively designates a refrigerated cabinet according to this invention.

The cabinet 1 comprises a counter 2 of elongate shape which is closed at opposed ends thereof by respective lateral end walls 3. Oppositely located side walls 4,5 of the counter 2, extending along the main dimension thereof, will be referred to as the customer and dealer sides of the counter because it is on these sides that the customer and dealer utilizing the cabinet 1 would stand, respectively.

From the free edge of the customer side wall 4, a series of first uprights 6 extend upwards; from the dealer side wall 5, there extend upwardly a corresponding series of second uprights 7. Said uprights, 6 and 7, are arranged to converge together above a display shelf 8 defined in the cabinet 1 where they are interconnected in pairs by box-type profile members 9.

Contiguous box-type members 9 are interconnected by channel members, not shown, which form housings and reflectors for lamps provided to illuminate the display shelf 8.

The uprights 6,7 and their related box-type members 9 form a supporting frame for a glazed deck 10 overlying the display shelf 8.

The glazed deck 10 includes plural front glass panels 11 which are hinged to the box-type members 9, opposedly located end walls glass panels 12 being an extension of the lateral sides 3, and plural back glass panels 13 which can be opened in a manner known per se.

The glazed deck 10 is closed at the top by a clear sheet panel 14 resting on the box-type members 9.

A work shelf 15 is formed along the dealer side 5 of the cabinet 1.

The cabinet 1 also accommodates a refrigerating system, not shown because it is quite conventional, which is arranged to maintain the space included between the display shelf 8 and glazed deck 10 at a lower temperature than the ambient temperature. This refrigerating system, comprising conventionally at least one compressor, one evaporator, and one condenser along with respective electric fans, is controlled from an electric console, generally designated 18.

The console 18 includes an elongate box-like case 20 which is mounted to one of the uprights 7 on the dealer side, preferably the one next to one lateral end wall 3.

The case 20 partly encloses its corresponding upright 7, to the extent of its appearing as an enlargement thereof. The case 20 is formed, on its side facing the customer side of the cabinet, with a substantially vertically extending wall 21 which accommodates a first digital display 22; the opposed side of the case 20 is formed with a substantially flat wall 23 which extends from the work shelf 15 to the overlying box-type member 9 and has a control panel of the console 18 defined thereon, as will be explained hereinafter.

In the wall 23, there is formed a housing for a second digital display 25 arranged to continuously display the temperature at which the foodstuff placed on the shelf 8 is being kept to the dealer. The display 25 constitutes a repeater of the display 22 (or vice versa). Both displays are connected to a thermal probe, not shown.

The wall 23 is covered at least in part by a flexible membrane 26 arranged to protect a number of indicators 27 and touch switches 28, provided in the panel 18 to control operation of the refrigerated cabinet 1 and making up said control panel.

One of the indicators 27 serves a warning purpose, to timely signify the dealer of the inception of anomalous thermal conditions in the normal operating cycle of the cabinet.

The other indicators will signify turning on of the refrigerating system, of a cabinet defrosting device, of one or more electric fans, and other ancillary functions. The membrane 26 would be formed with a clear portion at each indicator 27.

The switches 28 are preferably formed in the thickness of the membrane 26 itself, in accordance with conventional techniques in the art. Alternatively, the switches could be accommodated beneath the membrane 26 and operated by deforming the membrane.

The location of the electric console on the refrigerated cabinet of this invention is specially advantageous in that the control panel is at all times in full view of and readily accessed to by the dealer without interfering with the latter's normal activity.

In particular, the dealer is allowed to constantly monitor the thermal conditions of the cabinet through both the displays and the warning indicator.

Furthermore, by providing the membrane 26, the panel can be protected against fouling, and if required, be readily cleaned up.

The case 20 may advantageously incorporate the upright 7, or alternately if so sized as to be sufficiently strong, supplant it in its supporting function for the glazed deck 10.

I claim:

1. A refrigerated cabinet comprising:

a customer side wall;

a dealer side wall spaced from said customer side wall;

a pair of lateral end walls connected between said customer and dealer side walls;

a display shelf connected near upper ends of said customer side wall, dealer side wall and pair of lateral end walls;

a plurality of uprights extending above said display shelf;

a display glazed means supported by said plurality of uprights above said display shelf for at least partly enclosing a space above said display shelf; and an electric console associated with a refrigerating system of the cabinet to control operational functions thereof, operatively connected to one of said uprights adjacent said dealer side wall, said electric console including a vertically elongated box-like case.

2. A refrigerated cabinet according to claim 1 wherein said case at least partly encloses said one upright.

3. A refrigerated cabinet according to claim 1 wherein said case forms said one upright.

4. A refrigerated cabinet according to claim 1 including a work shelf extending near the top of and along the length of said dealer side wall, at least said uprights adjacent said dealer side wall extending above said work shelf, said case extending substantially the full length of said one upright to which said case is operatively connected.

5. A refrigerated cabinet according to claim 1 wherein said case includes a first temperature display facing in the direction of said customer side wall and second temperature display facing in the direction of said dealer side wall, one of said temperature displays being a repeater.

6. A refrigerated cabinet according to claim 1 wherein said electric console includes a control panel facing the direction of said dealer side wall and covered by a protective flexable membrane.

* * * * *

UNITED STATES PATENT AND TRADEMARK OFFICE

CERTIFICATE OF CORRECTION

PATENT NO. : 4,829,776

DATED : May 16, 1989

INVENTOR(S) : Giuseppe Cassanova

It is certified that error appears in the above-identified patent and that said Letters Patent is hereby corrected as shown below:

On the title page:

— [73] Assignee: Costan S.p.A.
Limana (Belluno), Italy —

Signed and Sealed this

Fifteenth Day of January, 1991

*Attest:*

HARRY F. MANBECK, JR.

*Attesting Officer*

*Commissioner of Patents and Trademarks*